United States Patent [19]

Smith

[11] 4,431,175

[45] Feb. 14, 1984

[54] FLOATING BELT FRICTION FEEDER

[75] Inventor: David W. Smith, Richardson, Tex.

[73] Assignee: Mead Corporation, Dayton, Ohio

[21] Appl. No.: 355,436

[22] Filed: Mar. 8, 1982

[51] Int. Cl.[3] ..... B65H 3/04

[52] U.S. Cl. ..... 271/10; 271/34; 271/167

[58] Field of Search ..... 271/34, 35, 10, 167, 271/245, 246

[56] References Cited

U.S. PATENT DOCUMENTS

| | | | |
|---|---|---|---|
| 3,485,489 | 12/1969 | Lindquist . | |
| 3,520,532 | 7/1968 | Towne . | |
| 3,734,490 | 5/1973 | Parks . | |
| 3,768,803 | 10/1973 | Stange . | |
| 3,844,552 | 10/1974 | Bleau | 271/245 |
| 3,907,159 | 9/1975 | Halm . | |
| 3,931,090 | 1/1976 | Amatangelo . | |
| 3,934,869 | 1/1976 | Strobel, Jr. . | |
| 3,941,373 | 3/1976 | Stange . | |
| 3,957,366 | 5/1976 | Taylor et al. . | |
| 3,988,017 | 10/1976 | Kyhl . | |
| 4,025,187 | 5/1977 | Taylor et al. . | |
| 4,074,902 | 2/1978 | Bradbury . | |
| 4,192,497 | 3/1980 | Perun et al. . | |
| 4,312,503 | 1/1982 | Saxinger | 271/34 |

*Primary Examiner*—Richard A. Schacher

*Attorney, Agent, or Firm*—Biebel, French & Nauman

[57] ABSTRACT

A sheet feeding device for separating a single sheet from a stack of sheets and forwarding the separated sheet away from the stack is disclosed which employs an endless friction belt cantilevered about a drive pulley such that the unsupported end of the belt floats freely on a stack of documents or paper sheets when the belt is in the feeding position. As the belt is driven about the pulley the unsupported end of the belt pulls and advances the foremost sheet from the stack and advances it over a retard member on which the unsupported end of the belt also floats. Because the belt floats freely on the stack of sheets, the normal force is evenly distributed over the surface of the belt, intersheet coupling is minimized, and the belt is able to conform to changes in the paper and stack condition.

13 Claims, 2 Drawing Figures

FLOATING BELT FRICTION FEEDER

BACKGROUND OF THE INVENTION

The present invention relates to a friction feeder for feeding sheets of paper from a stack. More particularly it relates to a feeder which employs a flexible friction belt. Typically, these belts are mounted on at least two pulleys which are spaced apart and define the initial advancement path of the sheet. Some typical examples of the many sheet feeding apparatus employing endless friction belts are disclosed in U.S. Pat. Nos. 3,485,489; 3,734,790; 3,768,803; 3,941,373; 3,957,366; and 4,025,187.

The geometric relationship and normal forces between the feed belt and head of the paper stack are crucial to achieving good feeder performance. While prior art feeders such as those illustrated in the aforementioned patents have been somewhat successful and found application in combination with present day high speed copy machines, their effectiveness is restricted by the mechanics upon which they are based. While in some instances elaborate mechanisms are employed to bias and hold the feed belt in contact with the paper stack, often these same mechanisms limit the degree of freedom with which the belt may move and, in turn, limit the belt's ability to adjust and conform to changes in the paper and stack condition. For instance, the mere fact that the belt is mounted for rotation on two pulleys itself limits the freedom of movement of the belt to one axis. Furthermore, contact between the belt and the stack is governed and often intentionally limited to a small area on the stack in prior art feeders by the orientation of the feeder belt and pulleys and their location with respect to the stack. When the movement of the belt is restricted to one axis, it is unable to conform to the stack and paper condition and it is over-sensitive to changes in the stack height. As a result, there is an undesirable misfeed frequency.

These feeders are typified in Stange, U.S. Pat. No. 3,768,803 (mentioned above). Stange features an arrangement where the feed belt removes the uppermost sheet of paper from the stack and (in cooperation with a retard means overwhich it rides) forms a queuing throat where the sheets are separated and aligned. Stange limits the contact between the feed belt and the stack to a point at the stack edge to minimize intersheet coupling and so that the belt acts on the sheet for the longest distance. Because this arrangement relies upon such minimal contact between the stack and the sheet and because the motion of the feed belt itself is limited to its path about the pulleys on which it is mounted, the Stange arrangement is relatively sensitive to changes in the nature and quality of the paper as well as changes in the stack height. Stange, U.S. Pat. No. 3,941,373 represents an analogous arrangement.

Lindquist, U.S. Pat. No. 3,485,489 also teaches a belt feeder in which the belt is positioned over a pair of pulleys to form a so-called tractor which is positioned to move a sheet of paper from the stack to an adjacent horizontal surface. In this embodiment the tractor can pivot from a position of engagement with the stack to a position of disengagement, but the freedom of movement of the belt and its contact with the stack are limited.

Park, U.S. Pat. No. 3,734,490 illustrates a feeding mechanism in which the belt is mounted on a pair of pulleys and traverses an idler wheel positioned between the pulleys inside the belt's path. The pulleys upon which the belt is mounted are spaced from the stack, but the idler wheel is movable up and down to force the belt into engagement with the top document in the stack. Lindquist and Parker illustrate a further drawback of prior friction belt feeder. That is, the belt is often biased against the paper stock using elaborate mechanisms which are not only expensive but subject to their own mechanical failures.

Bottom feeding devices, i.e., feeders adapted to remove a sheet from the bottom of a stack, sometimes take greater advantage of the flexibility in the belt and its ability to conform to the paper condition. Some examples are Strobel, U.S. Pat. No. 3,934,869 and Kyhl, U.S. Pat. No. 3,988,017. These arrangements, however, have their own disadvantages, in particular, as the amount of paper in the stack decreases, the normal force between the stack and the belt changes. Thus, while frictional feed belts have been used extensively in paper feeders, there is still a need for improvement. In particular, there is a need for a feeder system which is more responsive and less sensitive to changes in the stack height and the paper condition.

SUMMARY OF THE INVENTION

A principal object of the present invention is to provide a frictional belt feeder in which the belt readily adjusts to changes in the stack height and conforms to the surface condition of the paper.

Another object of the present invention is to provide a frictional belt feeder in which the normal force is evenly distributed over the belt surface, where high pressure point loading is avoided and intersheet coupling is minimized.

These objects are attained in accordance with the present invention which provides a sheet feeding device employing a cantilevered endless feed belt which is supported at one end about a pulley which drives the belt in rotation, while the other end of the belt floats freely under its own weight on the stack of sheets or documents to be fed. The sheet feeding apparatus of the present invention preferably employs a retard member over which the belt also floats to prevent more than one sheet from being fed by the belt at a time.

Because the feed belt of the present invention floats freely on the paper stack, the belt readily responds and is essentially insensitive to changes in the paper condition or the stack height. Thus, when in the course of a feeding operation the stack height fluctuates, because the belt sits on the stack under its own weight, it automatically moves with the stack and provides a continuous and reliable feed. Furthermore, in accordance with the present invention the belt is not positively biased against the stack by external actuator means. As a result, the normal force is evenly distributed over the surface of the belt and points of high pressure loading are not formed between the stack and the sheet to feed the paper. This minimizes intersheet coupling because the forces directed down the stack are not so large that the sheets frequently become mechanically bound to one another.

DETAILED DESCRIPTION OF THE INVENTION

Figure 1:
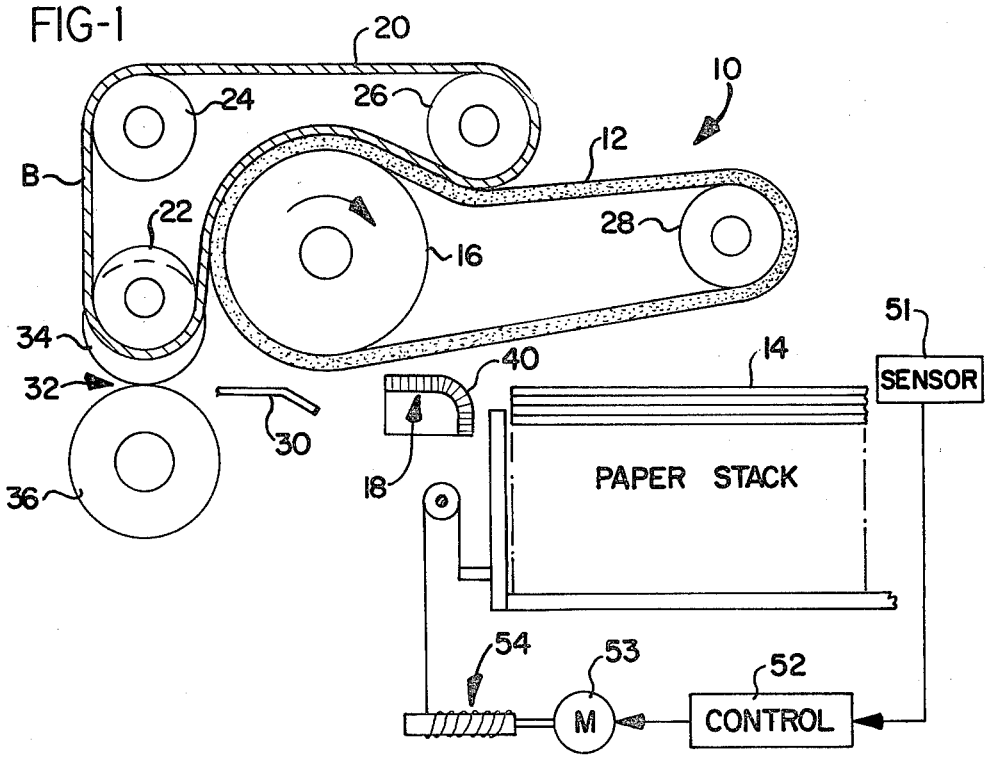
FIGS. 1 and 2 are schematic illustrations of one embodiment of the apparatus of the present invention where the belt is shown in the non-feeding and feeding positions, respectively.
Figure 2:
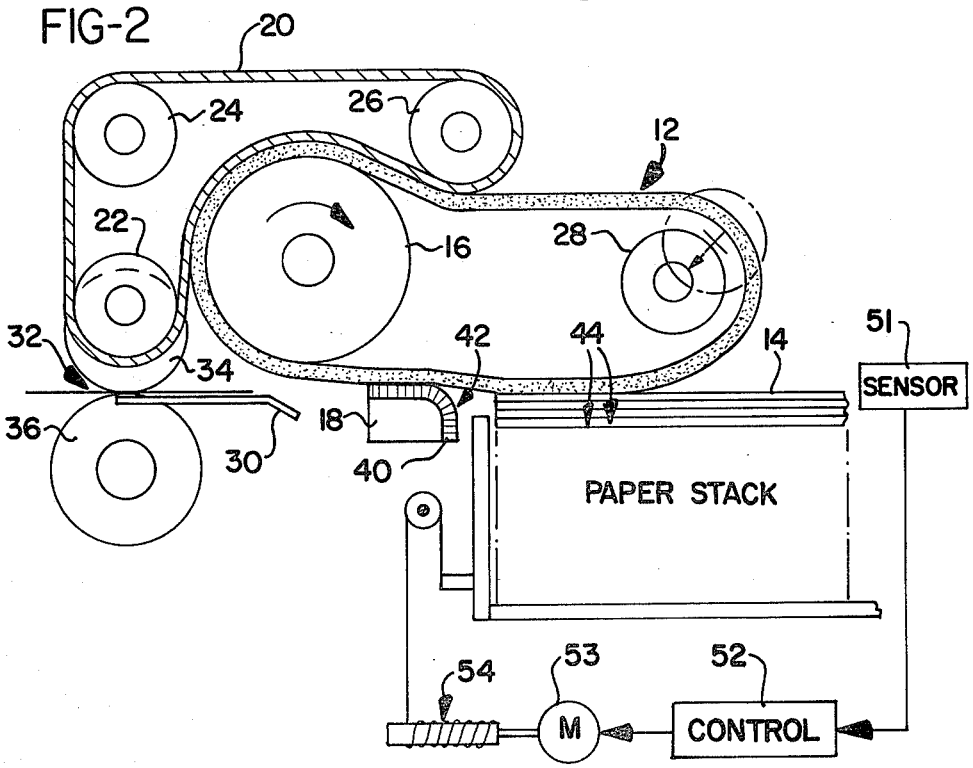

The apparatus of the present invention is generally indicated in FIGS. 1 and 2 by the numeral 10. This apparatus is characterized by a cantilevered feed belt 12, the unsupported end of which floats freely on a stack of documents or paper sheets 14 when in the feeding position (FIG. 2). Feed belt 12 is mounted on a drive pulley 16 which in the embodiments illustrated in FIGS. 1 and 2 is spaced from the stack 14. A retard member 18 is positioned between it and the stack 14. In the feeding position, the unsupported portion of belt 12 also floats freely over the retard member 18.

In the Figures, the feed belt 12 is wrapped around the drive pulley 16 by a second belt 20 mounted on a system of three pulleys 22, 24 and 26 positioned with respect to the drive pulley 16 such that the belt 12 is driven by drive pulley 16. Other wrapping or engagement means may also be suitable. For example, belt 12 may be biased against the drive pulley 16 by one or more backing rolls.

The feed belt 12 is moved between non-feed (FIG. 1) and feed (FIG. 2) positions by a positioning means which in the case of FIGS. 1 and 2 is an idler wheel 28. In the non-feed position at FIG. 1 idler wheel 28 supports the feed belt 12 out of contact with the paper stack 14. Preferably in this position the belt is also out of contact with the retard member 18 to prevent wear. From the position shown in FIG. 1, the idler wheel 28 pivots or moves to a position in which it does not support the belt 12 and the belt freely floats on the paper stack 14 as shown in FIG. 2. Belt 12 is sufficiently stiff to retain the general shape illustrated in FIG. 2, but is limp enough to droop downwardly against paper stack 14, as illustrated and thereby adjust to variations in the stack height. It will be appreciated that idler wheel 28 may be replaced by other equivalent positioning means.

In the feed position the unsupported end of belt 12 rests on paper stack 14. As drive wheel 16 rotates the belt, it pulls a sheet of paper from the stack 14 and advances it over the retard 18 to a delivery guide 30. While still in contact with the belt 12, the paper sheet is guided by delivery guide 30 to a nip 32 formed between a pair of pinch rollers 34 and 36. Pinch rollers 34 and 36 deliver the sheet removed from the stack 14 to the processing system used in conjunction with the feeding apparatus. As will be discussed in more detail below the belt must be of a sufficient size, weight and stiffness to provide the frictional force necessary to advance the paper from the stack without buckling or losing its alignment.

As previously indicated, the feed belt 12, in the feeding position, floats over retard member 18. Retard member 18 may assume many shapes, sizes and configurations, but preferably includes a resilient pad 40 having a curved leading edge. Retard member 18 functions in a manner described below to prevent more than one sheet of paper being fed to the processing system at a time. It has been found that loosely stacked paper is easily fed by feed belt 12 alone; no retard member being necessary. In the case where the sheets are frictionally interlocked, separation is effected by the cooperative action of the feed belt and the retard member.

In addition to a stationary pad, the retard member may take other forms such as a roller, shoe, endless belt, etc. A preferred resilient material for the retard member is a soft rubber having a durometer rating of about 40. Suitable elastomers include polyurethanes, poly(vinyl chloride), natural rubber, styrene-butadiene rubber, nitrile rubber, butyl rubber, etc. U.S. Pat. No. 4,192,497 teaches a microcellular elastomer having a hardness of at least 25 durometer which is also suitable in the present invention.

Feed belt 12 must be able to provide the frictional force necessary to advance the paper from the stack without losing its alignment. This means the belt must be of a minimum weight and stiffness depending on the size and weight of the paper or document to be fed. Preferably the belt combines a molded elastic material on its surface with a woven, non-elastic substrate. A variety of materials can be used. Dacron and rayon cord are suitable substrates. The molded elastic material may be a conventional rubber composition such as natural rubber, neoprene, styrene-butadiene rubber, polyacrylonitrile and isoprene. A preferred belt elastic is the isoprene rubber composition disclosed in U.S. Pat. No. 3,931,090 which contains polyisoprene, a metallic oxide, and a fatty acid among other ingredients. The belt should be wear-resistant and have the frictional properties next described.

Belt 12 has an annular length sufficient to carry sheets from the stack 14 and across retard member 18 to the sheet transporting means. Also, to the extent that the length of the belt affects the weight of the unsupported portion, the length of the belt can be one factor adjusted to provide the necessary frictional force. That is, the frictional force acting on the sheet is proportional to the normal force 44 of the belt on the sheet. The normal force is equal to the weight of the unsupported portion of the belt. Thus, the portion of the belt 12 which rests upon the stack 14 must be sufficient for the type of belt used to provide the frictional force necessary to transport the paper. In the case of a belt having the above-described preferred composition, the following belt dimensions have been found to be satisfactory:

annular length—8.8"
thickness—0.125"
width—1.00"

Typically the coefficient of friction of a belt of such material against paper is on the order of about 1.7.

In contrast to prior art devices, the apparatus of this invention does not utilize induced shingling or "fanning out" to separate, que and subsequently feed single sheets. Single sheet feeds are achieved by virtue of the fact that the floating belt applies the normal force 44 uniformly over a large area of the stack 14. This prevents high pressure point loading from being transmitted downward through the uppermost sheets of the stack and reduces the mechanical coupling between sheets which typically causes double and multiple feeds. However, if a second underlying sheet is also advanced, then retard member 40 provides a frictional separating force. The retard member 40 functions as a wiper having an appropriate geometry for creating a minimum interference to the leading edge of the sheet being advanced. In order to function in this manner the coefficient of friction of the surface of the retard member against paper must be higher than the coefficient of friction between sheets of paper but lower than the coefficient of friction of belt 12 against paper.

Normally, the paper hopper used in conjunction with the present invention will be equipped with an elevator means responsive to changes in the stack height or the weight of paper in the hopper. A typical elevation control may comprise a stack height sensor 51, a speed control 52, a motor 53 and a cable assembly 54, as illustrated schematically in FIG. 1. If the elevator control is good, the changes in the stack height relative to the belt will not be large, but some variation is always encountered. The belt of the present invention, because it freely floats on the surface of the stack, readily accommodates such changes in stack height.

The apparatus of the present invention can be used to feed a variety of papers including very thin papers ranging from less than 9 to about 15 pounds to very thick papers of weights in excess of 32 pounds. Where the sheet or document fed has an unusally large area, two or more cantilevered belts may be employed.

Having described the invention in detail and by reference to a specific embodiment thereof, it will be apparent to those skilled in the art that numerous variations and modifications are possible without departing from the spirit and scope of the following claims:

What is claimed is:

1. A sheet feeding apparatus for feeding individual sheets from a stack comprising:

an endless sheet feeding belt having a friction surface, a drive pulley about which said belt is cantilevered in driving rotation about an endless path, belt holding means for holding said belt in driving engagement with said drive pulley, movable positioning means for positioning said belt in a first position in which the unsupported portion of said cantilevered belt floats freely in contact with said stack of sheets and frictionally engages the uppermost sheet in said stack causing it to advance in the direction of said belt and a second position in which said belt is supported by said positioning means out of engagement with said stack by said positioning means.

2. The apparatus of claim 1 wherein said apparatus further comprises retard means positioned adjacent said stack in contact with said sheet feeding belt in said first position for separating the topmost of said sheets from other sheets fed therewith.

3. The apparatus of claim 2 wherein said apparatus further comprises a pair of pinch rollers and said belt feeds the uppermost sheet in said stack over said retard surface to said pinch rollers.

4. The apparatus of claim 3 wherein said belt and said retard member are formed of resilient materials which provide said belt with a coefficient of friction against paper which is greater than the coefficient of friction of said retard surface against paper.

5. The apparatus of claim 1 wherein said position means is an idler wheel.

6. The apparatus of claim 1 wherein said belt holding means comprises a second belt mounted on a series of pulleys so located with respect to said drive pulley that said second belt wraps said feed belt about a substantial portion of said drive pulley.

7. The apparatus of claim 3 further comprising means for elevating said stack of sheets.

8. The apparatus of claim 4 wherein said retard means comprises a pad having a curved leading edge.

9. The apparatus of claim 1 wherein said feed belt extends from said drive pulley to at least the middle of said stack of sheets.

10. Apparatus according to any of claims 1 through 9 wherein said positioning means is located inside said endless path.

11. A sheet feeding apparatus for feeding individual sheets from a stack comprising:

an endless sheet feeding belt having a friction surface, a drive pulley about which said belt is cantilevered in driving rotation about an endless path, belt holding means for holding said belt in driving engagement with said drive pulley, means supporting said stack of sheets with the top of said stack in engagement with said sheet feeding belt so that said belt floats on said stack and feeds sheets therefrom, retard means positioned adjacent said stack and in contact with said belt for separating the topmost one of said sheets from other sheets which are fed therewith, and elevating means for adjusting the height of said stack to maintain the top thereof in contact with said belt during the feeding of sheets therefrom.

12. Apparatus according to claim 11 and further comprising movable positioning means located inside said sheet feeding belt for lifting said sheet feeding belt out of contact with said stack and said retard means.

13. Apparatus according to either of claims 11 or 12 wherein said holding means comprises a second belt mounted on a series of pulleys so located with respect to said drive pulley that said second belt wraps said sheet feeding belt around a substantial portion of said drive pulley.

* * * * *